United States Patent [19]

Mester

[11] 3,939,352

[45] Feb. 17, 1976

[54] X-RAY GENERATOR PROVIDED WITH STARTING LOAD CONTROL

[75] Inventor: Heinz Mester, Hamburg, Germany

[73] Assignee: U.S. Philips Corporation, New York, N.Y.

[22] Filed: Feb. 8, 1974

[21] Appl. No.: 440,718

[30] Foreign Application Priority Data

Feb. 22, 1973 Germany ..... 2308681

[52] U.S. Cl. ..... 250/409; 250/413

[51] Int. Cl.[2] ..... H05G 1/30

[58] Field of Search ..... 250/403, 404, 405, 407, 250/408, 409, 413, 417

[56] References Cited

UNITED STATES PATENTS

| | | | |
|---|---|---|---|
| 2,993,124 | 7/1961 | Graves et al. | 250/413 |
| 3,061,729 | 10/1962 | Craig | 250/413 |
| 3,449,574 | 6/1969 | Duffy | 250/413 |
| 3,746,862 | 7/1973 | Lombardo et al. | 250/409 |

*Primary Examiner*—James W. Lawrence
*Assistant Examiner*—D. C. Nelms
*Attorney, Agent, or Firm*—Frank R. Trifari; Ronald L. Drumheller

[57] ABSTRACT

In an X-ray generator, different starting powers may be selected and corresponding to each starting power a different reduction instant is measured at which time resistors are inserted into the high-voltage and the filament circuits to reduce power. Different starting powers may be associated with different organ exposures in which case the system has advantages similar to those where the load is reduced in several steps without the high cost.

3 Claims, 4 Drawing Figures

X-RAY GENERATOR PROVIDED WITH STARTING LOAD CONTROL

The invention relates to an X-ray generator provided with starting load control in which a starting power supplied to the X-ray tube at the beginning of an exposure can be reduced to a lower value at a given instant, hereinafter termed the reduction instant, the reduction instant and the starting power being matched with one another according to the load capacity of the tube.

As is known, X-ray generators in which the power supplied to the X-ray tube is continuously reduced from a maximum value at the beginning of the exposure so that the focal spot temperature has a substantially constant just permissible value yield the shortest possible exposure times at a given load capacity of the tube. Continuous reduction of the power supplied to the X-ray tube at a constant tube voltage requires an increased complexity and amount of equipment.

Hence a procedure has been adopted in which the power supplied to the X-ray tube is reduced in steps. Reduction of a power is effected by decreasing the current through the X-ray tube. To prevent the voltage across the X-ray tube from being increased as a result of the decrease of the tube current, resistors are connected in the primary circuit.

Figure 1:
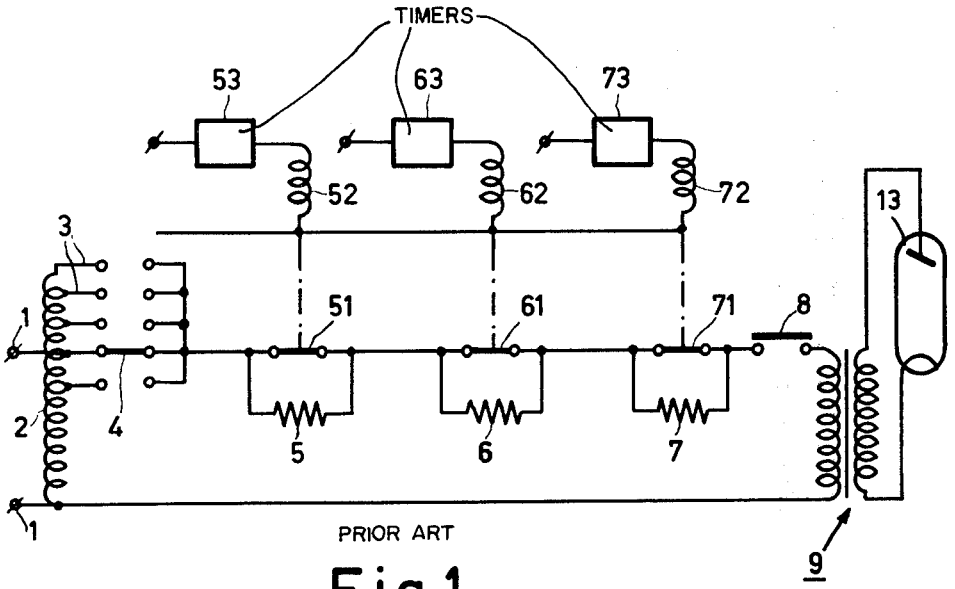
PRIOR ART Fig.1
FIG. 1 shows diagrammatically part of a prior art circuit diagram of the present type.

In the drawings component parts having the same functions are denoted by the same reference numberals.

The mains voltage set up across terminals 1 is applied to an autotransformer 2. The autotransformer 2 has several tappings 3 from which different voltages may be derived in operation. One of these tappings is connected to the primary of a high-voltage transformer via a contact 4 and three series-connected resistors 5, 6 and 7 and a switch 8 operated by a timer switch or automatic exposure device. The resistors 5 6 and 7 are shunted by contacts 51, 61 and 71 respectively of relays 52, 62 and 72 respectively which are actuated by timers 53, 63 and 73 respectively.

At the beginning of an exposure the three contacts 51, 61 and 71 are closed and the current flowing through, and hence the power supplied to, the X-ray tube are a maximum. At an instant $t_0$ the current is reduced in that a resistor, not shown, is connected in the filament circuit of the X-ray tube. To prevent the voltage across the tube from rising owing to the reduced voltage drop in the primary circuit and in the secondary circuit of the X-ray tube, at this instant the contact 51 of the relay 52 is opened so that the resistor 5 is included in the primary circuit. At an instant $t_1$ the current is again reduced and the contact 61 is opened, so that the resistor 6 also is included in the primary circuit of the high-voltage transformer, and finally at an instant $t_2$ the current is reduced a third time and the contact 71 is opened so that from this instant all three resistors 5, 6 and 7 are included in the primary circuit of the high-voltage transformer.

Figure 2:
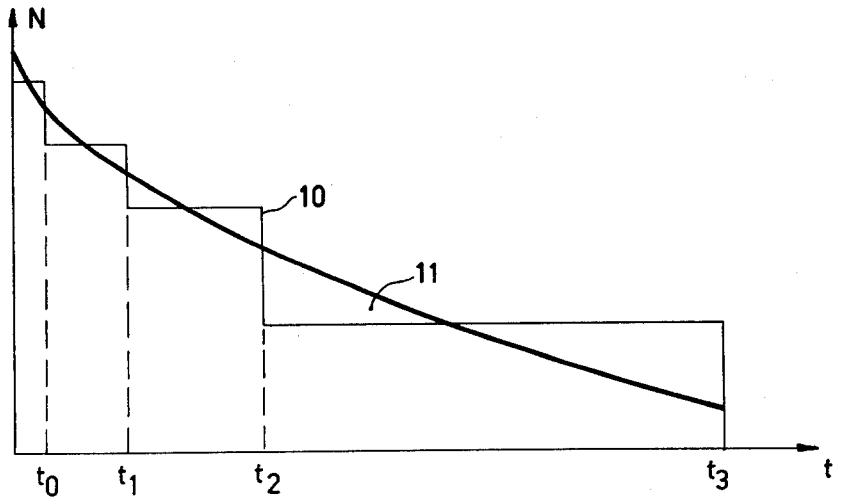
FIG. 2 is a curve which shows the variation of the power N supplied to an x-ray tube as a function of time $t$ by the circuit of FIG. 1.

The variation of the power N as a function of time $t$ in such an X-ray generator is shown in FIG. 2 by a line 10, a curve 11 showing the variation of the power with time in an X-ray generator with continuously decreasing load. The greater the number of steps, the better the X-ray tube is utilised but also the higher are the complexity and the amount of equipment required, for each step requires the addition of a resistor and of a relay for connecting the resistor into circuit. Such relays are comparatively expensive becuase they are required to switch the total primary current, which may be in the order of 100 amperes.

The cost may be maintained low by providing only a single switching step, thus requiring only one resistor and one relay for connecting the resistor into circuit. However, in order to permit the high short-time power of the X-ray tube to be fully utilised the change-over would have to be effected within the range of the short exposure times from 0.1 to 0.3 seconds. But this means that all the radiographs completed within a period about equal to from 1.25 to 7 times the change-over time have their exposure times undesirably and unnecessarily lengthened.

Hence it is an object of the present invention to provide an X-ray generator of the type referred to such as to enable the X-ray tube to be better utilised at small cost.

According to the invention this is achieved by the use of different reduction instants and associated starting powers. Unlike the known X-ray generators which each have only one starting power which is reduced at a predetermined instant, the X-ray generator according to the invention has a plurality of starting power levels which — according to the load capacity of the tube — are reduced to a lower level at different reduction instants.

The invention may in principle be used in all X-ray generators provided with an automatic exposure device or selective adjustment for the exposure data (often referred to as two button operation). In X-ray generators in which the high voltage and the mAs product are adjustable, adjustment of the high voltage and of the mAs product determines an energy which may be associated with a given starting power and reduction instant so that in the case of small energies initially a high starting power is used which after a short time is reduced to a lower value, whilst in the case of large energies initially a low starting power is used which is reduced to a lower value after a comparatively long time. However, account must then be taken of the fact that owing to the use of different starting powers, i.e. different starting currents, the preset primary voltage at the high-voltage transformer may produce different high voltages so that the preset primary voltage must be corrected in accordance with the starting power set.

Such correction is comparatively expensive, so that any savings due to the single-step power reduction according to the invention are partly lost. However, the advantages of the invention will be fully manifest if according to a further aspect of the invention a presetting device for presetting the exposure data for the different organs is provided, for this enables the dependence of the secondary voltage upon the starting power and the starting current to be taken into account during presetting.

presetting of the exposure data of different organs is also referred to as "programmed exposure technology" or as "automatic organ exposure". If for example a stomach exposure is to be made, a selector button inscribed "stomach" is depressed which causes exposure data preset for the stomach to become operative, i.e. for example the required focal spot (large or small), the preset voltage, the starting current and — in X-ray generators having no automatic exposure system — by means of a separate setting member the mAs product are switched on. When an automatic exposure system is used the focal spot, the tube voltage, the starting current, the measuring field combination and the required dose (density) are set by means of the switch together with the organ selection. In X-ray generators of the said type the invention can be used either in combination with or without the automatic exposure system.

In general, in order to reduce the starting current and to maintain the secondary voltage constant resistors are simultaneously connected into the filament circuit and into the primary circuit, and a further aspect of the invention is characterized in that this connection is effected by a timer having a selectable switching instant depending upon the organ (in X-ray generators provided with an "organ-automatic system") and/or the exposure energy.

Figure 3:
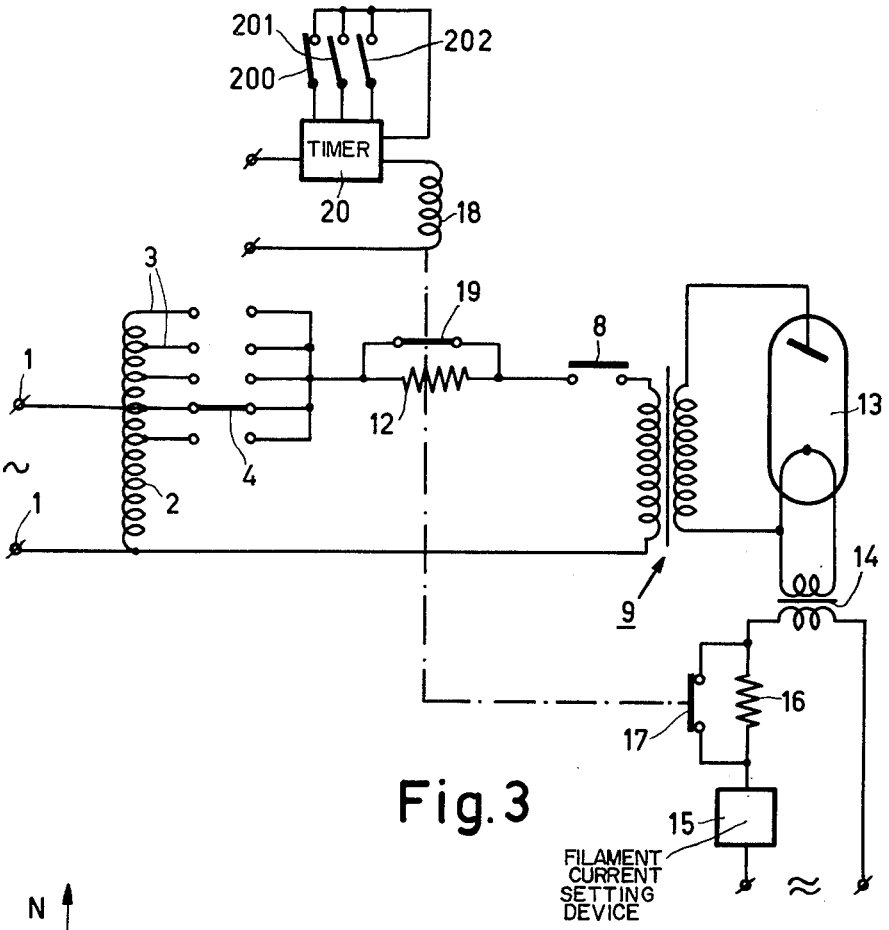
FIG. 3 is a circuit diagram of an X-ray generator according to the invention for programmed exposure technology and FIG. 4 is a curve which shows the variation of the power N supplied to an X-ray tube as a function of time $t$ by the circuit of FIG. 3.

A preferred embodiment of the invention will now be described, by way of example, with reference to the X-ray generator shown in FIG. 3. The mains voltage set up across terminals 1 is applied via an autotransformer 2, one of the tappings 3 thereof, a contact 4, a contact 8 of an automatic exposure device or of a mAs switch and a resistor 12 to the primary winding of a high-voltage transformer 9 the secondary circuit of which includes an X-ray tube 13 and possibly rectifiers. In a primary circuit of a transformer 14 for the filament current of the X-ray tube 13 a setting device 15 connected in series with a resistor 16 is provided for setting a starting current. The resistor 16 is shunted by a contact 17 of a relay 18 which has another contact 19 which shunts the resistor 12. The relay winding 18 is connected in an output circuit of a timer 20 which enables the relay to operate at a predeterminable instant $t_0$, $t_1$ or $t_2$ according to which one of contacts 200, 201 or 202 respectively is closed. The timer may include timing circuits which consist of RC stages and to which, by means of the contacts 200 to 202 which may, for example, be selected by the switches of the organ-automatic system, resistors of different values may be connected in parallel, resulting in different switch-on instants.

Figure 4:
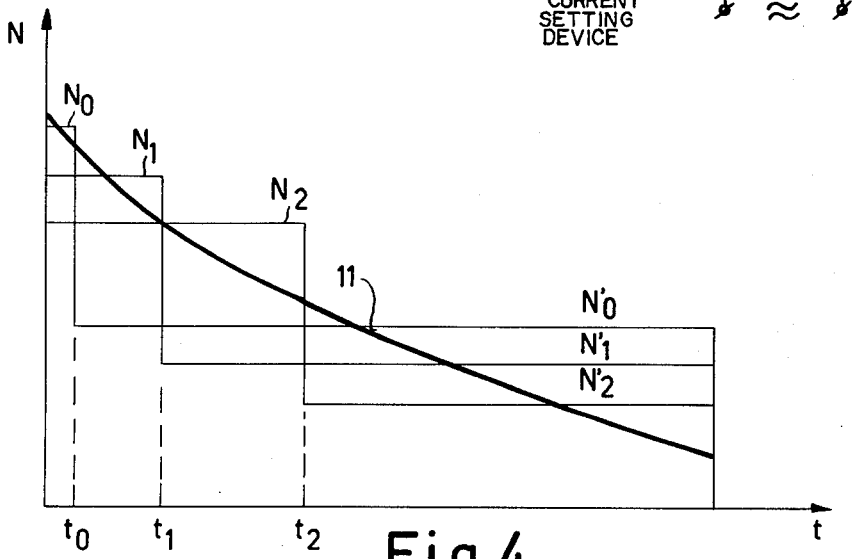

When the voltage and the starting current are adjusted so that at the setting of the timer 20 at which change-over is effected at the instant $t_0$ a starting power $N_0$ is produced and correspondingly at reduction instants $t_1$ and $t_2$ starting powers $N_1$ and $N_2$ respectively are produced and when then at the instant $t_0$, $t_1$ or $t_2$ respectively the contacts 17 and 19 are opened so that, with the high voltage remaining constant, the tube current and hence the tube power are reduced to a value $N_0'$, $N_1'$ or $N_2'$ respectively, the time variation of the power supplied to the X-ray tube 13 shown in FIG. 4 is obtained. Thus the starting power — $N_0$, $N_1$ or $N_2$ — is reduced to a final value $N_0'$, $N_1'$ or $N_2'$ respectively once only, where $N_0/N_0' = N_1/N_1' = N_2/N_2'$.

The various organs of which exposures are to be made by means of the X-ray tube can be associated with one of the three systems $N_0/t_0$, $N_1/t_1$ or $N_2/t_2$. If for example a large part of all the lung exposures can be made with X-ray generators with continuously decreasing load and constant tube power — for example 90% within the time ending at $t_0$— in an apparatus according to the invention the exposure button inscribed "lung" is associated not only with the high voltage etc. but also with the reduction instant $t_0$ and a starting current which together with the high voltage produces the starting power $N_0$. The selector button for exposures of the stomach or the spinal column are associated with the reduction instants $t_1$ and $t_2$ and the powers $N_1$ and $N_2$ respectively if it is found, in the case of an X-ray generator of continuously decreasing load and with the tube load remaining constant, that a major part, for example 90%, of the exposures can be completed only in the period ending at $t_1$ and $t_2$ respectively. Thus in an X-ray generator for programmed exposure technology exposure durations are achieved which are only slightly longer than the exposure durations with a continuously decreasing load.

Accordingly, in order to preset the exposure data for a lung exposure the button inscribed lung is associated with the starting current required for the starting power $N_0$ and with a primary voltage which together with the starting current results in the desired secondary voltage, and in the timer 20 the contact 200 is preset which is to be closed to achieve the exposure duration $t - t_0$. Similarly the presettings for the exposure buttons for other organs (stomach, kidneys, etc.) are effected.

When the contacts 17 and 19 are opened at the beginning of the exposure, a power $N_0'$, $N_1'$ or $N_2'$ is supplied to the X-ray tube and the current is not reduced during exposure. Thus various fixed current values can simply be set.

Although in the X-ray generator according to the invention the power can be reduced in a single step only, substantially the same results are achieved as in an X-ray generator the load of which is reduced in several steps. The cost, however, only slightly exceeds that of known X-ray generators the load of which is reduced in one step, whilst only a timer is required which instead of a fixed predetermined reduction time permits different reduction instants to be set at will.

Although in the aforedescribed embodiment the invention has been described with reference to an X-ray generator using a single-phase mains voltage, the invention may also be used in multi-phase devices, in which case the saving obtainable by the invention is even multiplied.

What is claimed is:

1. An X-ray generator circuit for an X-ray tube, comprising means for starting the X-ray tube at any selected one of a plurality of different starting powers, all of which are higher than the maximum continuous power at which the X-ray tube may to operated, the load capacity of the X-ray tube limiting to different respective time intervals the maximum period during which the tube should be operated at said different starting powers; timing means for measuring said different respective time intervals; and switching means responsive to said timing means for automatically reducing the power of the X-ray tube to a suitably lower power when the X-ray tube has been operated at the selected starting power for the time interval associated with the selected starting power.

2. In an X-ray generator wherein exposure data for exposing a body organ are automatically preset upon selection of the body organ, an X-ray generator circuit as defined in claim 1 wherein the different starting powers correspond to different respective organs, the starting power being automatically selected and preset upon selection of the body organ.

3. An X-ray generator circuit as defined in claim 1 and further comprising a first resistor which may be switched by said switching means into the high-voltage circuit of the X-ray tube to reduce the high voltage thereto, and a second resistor which may be simultaneously switched by said switching means into the filament-current circuit of the X-ray tube to reduce the filament current thereof, thereby reducing the power of the X-ray tube to a suitably lower power.

* * * * *

UNITED STATES PATENT AND TRADEMARK OFFICE

CERTIFICATE OF CORRECTION

PATENT NO. : 3,939,352

DATED : February 17, 1976

INVENTOR(S) : HEINZ MESTER

It is certified that error appears in the above-identified patent and that said Letters Patent are hereby corrected as shown below:

IN THE SPECIFICATION

Column 3, line 1, "presetting" should be --Presetting--;

IN THE CLAIMS

Claim 1, line 5, "to" should be --be--.

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*